US009068444B2

(12) United States Patent
Lane et al.

(10) Patent No.: US 9,068,444 B2
(45) Date of Patent: Jun. 30, 2015

(54) GAS LIFT SYSTEM HAVING EXPANDABLE VELOCITY STRING

(75) Inventors: William C. Lane, The Woodlands, TX (US); Deborah L. Banta, Humble, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 726 days.

(21) Appl. No.: 13/368,564

(22) Filed: Feb. 8, 2012

(65) Prior Publication Data

US 2013/0199794 A1 Aug. 8, 2013

(51) Int. Cl.

| | |
|---|---|
| ***E21B 43/00*** | (2006.01) |
| ***E21B 43/12*** | (2006.01) |
| ***E21B 34/00*** | (2006.01) |

(52) U.S. Cl.

CPC ..... *E21B 43/122* (2013.01); *E21B 34/00* (2013.01); *E21B 43/00* (2013.01)

(58) Field of Classification Search

CPC ... E21B 43/105; E21B 43/108; E21B 43/122; E21B 34/00; E21B 43/00

USPC ..... 166/207, 384, 208, 316, 372

See application file for complete search history.

(56) References Cited

U.S. PATENT DOCUMENTS

| | | | | |
|---|---|---|---|---|
| 5,027,903 | A * | 7/1991 | Gipson | 166/382 |
| 6,978,843 | B2 | 12/2005 | Gleim et al. | |
| 7,134,495 | B2 * | 11/2006 | Vloedman et al. | 166/277 |
| 7,367,401 | B2 | 5/2008 | Moffett et al. | |
| 7,409,998 | B2 | 8/2008 | Campbell | |
| 7,434,622 | B2 | 10/2008 | Luke et al. | |
| 7,980,302 | B2 | 7/2011 | Ring et al. | |
| 8,028,749 | B2 * | 10/2011 | McHardy et al. | 166/207 |
| 2002/0170716 | A1 | 11/2002 | Newman | |
| 2003/0111222 | A1 | 6/2003 | Newman | |
| 2003/0141111 | A1 * | 7/2003 | Pia | 175/57 |
| 2003/0183397 | A1 | 10/2003 | Hoffman | |
| 2004/0035584 | A1 | 2/2004 | Gleim et al. | |
| 2006/0065408 | A1 | 3/2006 | Green et al. | |
| 2006/0124308 | A1 | 6/2006 | Davis | |
| 2007/0151360 | A1 * | 7/2007 | Ring et al. | 73/834 |

(Continued)

FOREIGN PATENT DOCUMENTS

| | | |
|---|---|---|
| CA | 2622596 | 3/2006 |
| GB | 2418683 | 4/2006 |
| GB | 2463400 | 3/2010 |

OTHER PUBLICATIONS

"Agitator Tool: Technical Summary," by National Oilwell Varco (c) 2009, 2 pages, Brochure No. D392001564-MKT-001 Rev. 04, www.nov.com/downhole.

(Continued)

*Primary Examiner* — Daniel P Stephenson

(74) *Attorney, Agent, or Firm* — Wong, Cabello, Lutsch, Rutherford & Brucculeri, LLP

(57) ABSTRACT

A velocity string deploys in production tubing of a gas well (or a gassy oil well) to help lift fluid toward the surface. The velocity string reduces flow area in the production tubing so that a critical flow velocity can be reached to lift liquid. Overtime, the reservoir pressure and resulting gas flow may decrease such that less liquid is produced toward the surface. At such a stage, operators then expand the velocity string to further decrease the flow area in the production tubing, which can produce the needed critical flow velocity to allow produced liquid to be lifted toward the surface.

39 Claims, 6 Drawing Sheets

(56) References Cited

U.S. PATENT DOCUMENTS

| | | | | |
|---|---|---|---|---|
| 2008/0017387 | A1 | 1/2008 | Green et al. | |
| 2009/0223680 | A1 | 9/2009 | Green et al. | |
| 2011/0168386 | A1 | 7/2011 | Green et al. | |
| 2011/0232377 | A1* | 9/2011 | Sierra | 73/152.18 |
| 2012/0298377 | A1* | 11/2012 | Smith et al. | 166/380 |
| 2013/0199794 | A1* | 8/2013 | Lane et al. | 166/372 |
| 2013/0312977 | A1* | 11/2013 | Lembcke et al. | 166/311 |
| 2014/0124199 | A1* | 5/2014 | Gorrara et al. | 166/268 |
| 2014/0182860 | A1* | 7/2014 | Harsono et al. | 166/368 |
| 2015/0000929 | A1* | 1/2015 | Veeken et al. | 166/375 |

OTHER PUBLICATIONS

"Fiberspar Tech Notes; Product, service and cost savings information from the leader in spoolable LinePipe and Production Systems," by Fiberspar Production Systems, TN19-r1-UNI (c) 2010 Fiberspar LLC, www.fiberspar.com, 1 page.

"Fiberspar Tech Notes; Product, service and cost savings information from the leader in spoolable LinePipe and Production Systems," by Fiberspar Production Systems, TN21-r2-UNI (c) 2011 Fiberspar LLC, FBS1108 (0311/300) www.fiberspar.com, 2 pages.

"Fiberspar Tech Notes; Product, service and cost savings information from the leader in spoolable LinePipe and Production Systems," by Fiberspar Production Systems, TN22-r1-UNI (c) 2010 Fiberspar LLC, FBS1022 (1110) www.fiberspar.com, 1 page.

"Applications, Fiberspar, Production Systems," obtained from www.fiberspar.com/fiberspar/downhole-products/applications/, obtained on Dec. 14, 2011, 2 pages.

"Enhancing Production and Improving Lift Efficiency in Low-Pressure Wells with Liquid-Loading Conditions," Fiberspar, www.fiberspar.com, 12 pages.

"Fiberspar LinePipe The Leader in Spoolable Pipline Systems," Fiberspar, www.fiberspar.com; (c) 2012 Fiberspar LLC, (FBS921/web_US&CAD/0510), 22 pages.

"Overview, Fiberspar Technology," Fiberspar, obtained from www.fiberspar.com/fiberspar/linepipe/tech-information/overview, generated on Dec. 14, 2011, 2 pages.

"Review and Selection of Velocity Tubing Strings for Efficient Liquid Lifting in Stripper Gas Wells," Final Technical Report May 15, 2002 to Apr. 30, 2004, Submitted by George Koperna, Jr., Submission Date May 31, 2004, DOE Award No. DE-FC26-00NT41025, Subcontract No. 2281-ARI-DOE-1025, Submitting Organization Advanced Resources International, Inc., 53 pages.

"PolyFlow, Inc.—Exploration and Production—Velocity String Tubing," obtained from www.polyflowinc.com/products-downhole-tubing-velocity.htm, generated on Dec. 13, 2011, 2 pages.

"PolyFlow, Inc.—Products—Velocity String Tubing," obtained from www.polyflowinc.com/products-downhole-tubing-velocity.html, generated Sep. 5, 2011, 2 pages.

"Thermoflex Installation Guide Ø1.00" Thru Ø1.75" Velocity Strings," PolyFlow, Inc., Oct. 21, 2002, www.polyflowinc.com, Publication No. 001, Effective Date Aug. 1, 2005, Supersedes Rev. 2, 10 pages.

"WCVR—Critical Velocity Reducing System: A Creative Combination of: Area Reduction, Surface Tension and Density Reduction (Foamer), Plunger Lift," Weatherford (c) 2006, 28 pages.

"World Oil, Coiled Tubing Technology," obtained from www.worldoil.com/February-2005-Tapered-coiled-tubing-reaches-extreme-depths.html, generated on Dec. 31, 2011, 4 pages.

"Using Coiled Tubing Equipment to Run Complex Jointed Tubing Velocity Strings," by J. Rignol and J.-M. Krepa, Total E&P Nederland B.V., et al. SPE 93586, Copyright 2005, Society of Petroleum Engineers Inc., presented at the 2005 SPE/ICoTA Coiled Tubing Conference held in The Woodlands, TX Apr. 12-13, 2005, 11 pages.

* cited by examiner

GAS LIFT SYSTEM HAVING EXPANDABLE VELOCITY STRING

BACKGROUND

Liquids can accumulate in gaseous wells (e.g., natural gas wells and gassy oil wells) and can create backpressure on the formation, which slows further production of hydrocarbons. To increase the inflow of hydrocarbons into the wellbore, the liquids must be removed so that the backpressure on the formation can be reduced. A number of technologies for dealing with liquid accumulation are used in the art.

To help explain liquid accumulation, the lift system 10 in FIG. 1 has production tubing 30 deployed in a casing 22 of a wellbore 20 for a natural gas well. The casing 22 has perforations 24 so that the natural gas well produces gas and liquid, such as water and hydrocarbon, from the reservoir, and a production tubing packer 32 isolates the casing annulus from the formation fluid (gas G and liquids L). The production tubing 30 conveys the produced fluid to the wellhead 12 at the surface. As is known, the production rate of the natural gas well is a function of the pressure differential between the underground reservoir and the wellhead 12. As long as the pressure differential creates a critical velocity (i.e., sufficient gas flow velocity or gas flow rate to displace the liquids) in the well, then the produced fluid (gas G and liquid L) can be lifted through the production tubing 30 to surface.

Unfortunately, the pressure differential decreases when the reservoir pressure declines over time and when backpressure in the well acts against the reservoir pressure. As natural gas G and associated liquids L are extracted during production, the gradual loss of the reservoir pressure occurs in some natural gas wells, thus decreasing the pressure differential. Additionally, the produced liquids, such as water and hydrocarbon, can tend to accumulate in the wellbore 20 and reduce the well's production rate, as noted previously.

Unaided removal of these produced liquids L depends on the velocity of the gas stream produced from the formation. As the reservoir pressure and the flow potential decreases in the well, a corresponding drop occurs in the flow velocity of the natural gas G through the production tubing 30 to the wellhead 12. Eventually, the flow velocity becomes insufficient to lift the liquids L so that a column of liquids L accumulates in the wellbore 20. This liquid loading phenomenon decreases the production of the well because the weight of the fluid column above the producing formation produces additional backpressure on the reservoir.

Various "dewatering" techniques can be used to deal with liquid accumulation. For example, mechanical pumps can pump the accumulated liquid L to the surface, but mechanical pumps are typically inefficient in gassy wells. One efficient dewatering technique for a gas well is to increase flow velocity to above critical velocity by decreasing the cross-sectional area through which the fluids must flow. Reduced flow area allows the flowing fluid pressure to increase, thereby increasing the difference between the pressure in the wellbore 20 and the pressure of the surface flow line 19. This increase in pressure differential results in increased flow velocity.

One method of increasing velocity by reducing flow area is by using a small-diameter tubing string run inside the production tubing 30 of the well. This "velocity string" 40 can be deployed from a coiled tubing reel 14 through an injector 16 on the wellhead 12 and into the production tubing 30. The flow of produced fluid may be up the smaller internal diameter 45 of the velocity tube 40.

Another method of increasing velocity by reducing flow area is to use the inserted string 40 as dead space to reduce the flow area within the production tubing 30. Disposed in the production tubing 30, this "dead string" 40 produces an annular flow path in the micro-annulus 35 (i.e., the space between the outside of the velocity string 40 and the inside of the production tubing 30). As shown in FIG. 1, produced fluids pass from the formation into the wellbore 20 through the perforations 24 and can be lifted to the surface by the fluid velocity through the micro-annulus 35.

The string 40 (whether used as a "velocity string" or a "dead string") must be configured to produce flow velocities higher than critical velocity while minimizing flow restrictions beyond that which is necessary to achieve critical velocity. Therefore, the string 40 can quickly become ineffective as gas flow declines. In particular, the reservoir pressure in the gas well can eventually be depleted over time to the point where there may be insufficient velocity to transport all liquids from the wellbore 20 to the surface. Although gas can be injected from the surface to help increase the velocity of produced gas, the injected gas adds to the backpressure downhole and potentially can retard inflow of well fluids into the wellbore 20.

In another technique, operators can inject surfactant into the wellbore 20. Typically, the foam is dispersed near the perforated section at the casing's perforations 24. The surfactant reacts with water to reduce the water's surface tension so it foams in the presence of turbulence, thereby reducing the apparent liquid density of the water and reducing the critical velocity needed to lift the water from the system 10.

For vertical wells, many of the conventional lift systems can be used to increase gas production, but such conventional systems are less effective in the horizontal sections of wells. For example, horizontal wells may often have more than one relative low spot where liquids can pool so that dealing with the pooled liquids in horizontal wells can be particularly problematic. A mechanical pump is limited to suction at one point in the wellbore and cannot realistically address multiple low spots that may be present in horizontal wells. Although injecting foam surfactant in a vertical wellbore can be relatively straightforward, dispensing the foam surfactant at correct concentrations into multiple low spots of a horizontal wellbore can be challenging and expensive. Finally, a velocity string deployed in production tubing of a horizontal wellbore can quickly become ineffective as well pressures decline, especially when used in shale gas wells having steep declining curves.

The subject matter of the present disclosure is directed to overcoming, or at least reducing the effects of, one or more of the problems set forth above.

SUMMARY

To help lift fluid (e.g., water and hydrocarbons) produced from a gaseous well (e.g., a gas well or a gassy oil well) toward the surface, operators may deploy a velocity or dead string in production tubing of the well. As is known, a "velocity" string may refer to a string that deploys in tubing and is intended to have flow up through an internal passage of the string. By contrast, a "dead" string may refer to a string that deploys in tubing, but is not intended to have flow up through the string. Either way, reference herein to a "string," a "velocity string," a "dead string," and the like can mean either one of these configurations depending on the implementation.

In general, the production tubing can be perforated casing, perforated tubing installed in casing, or any other typical configuration. Deployment of the velocity string in the production tubing may be facilitated for a horizontal well by lubricating the production tubing, vibrating the velocity string in the production tubing with an agitator, or pulling the velocity string with a tractor in the production tubing.

When installed in the production tubing, the velocity string essentially reduces the flow area in the production tubing so that a critical flow velocity can be reached to lift liquid toward the surface. The velocity string can lift the liquid all the way to the surface. Alternatively, the velocity string can lift the liquid at least partially toward the surface because the string can be used just to move the liquids through the wellbore's horizontal and deviated sections. At some point, a different lift technology (e.g., plunger lift, mechanical lift, etc.) may be used to lift the liquids the rest of the way to the surface wellhead 12.

Overtime, the pressure in the well may decrease, causing the flowing gas velocity to decrease resulting in less liquid produced to the surface. At such a stage, operators can then expand/restrict/or increase the space taken up by the velocity string to further decrease the reduced flow area in the production tubing. This further decrease in the flow area can produce the needed critical flow velocity to allow produced liquid to again be lifted to the surface or at least partially toward the surface.

By expanding, restricting, or increasing the space it takes up, the velocity string can be "expanded" or "constricted" as the case may be because its cross-sectional dimension can be changed while deployed downhole. For simplicity, the velocity string is referred to herein as an "expandable velocity string," but it will be understood that other configurations are also possible with the benefit of the present disclosure.

When initially deployed, the expandable velocity string can have an unexpanded state with an initial cross-sectional area. Flow of produced fluid can then pass through the micro-annulus between the inside of the production tubing and the outside of the velocity string. When expanded, however, the velocity string has an expanded state with an increased cross-sectional area. In this way, the micro-annulus or passing the produced fluid is decreased in area, which in turn can increase the flow velocity. In general, expansion of the velocity string can be accomplished in one or more stages while deployed in the production tubing.

One technique for expanding the velocity string while deployed in the production tubing uses fluid pressure injected from the surface into an internal passage of the velocity string. The injected pressure causes the string to expand, and a check valve on the velocity string can release excess pressure from the string to the production tubing.

Another technique for expanding the velocity string while deployed in the production tubing uses an expander tool forced through the string's internal passage. The expander tool can be forced by fluid pressure applied down the string's internal passage against the expander tool to move it along the length of the string. Alternatively, coiled rod or tubing deployed from the surface can force the expander tool through the string's internal passage to expand the string. The expander tool can also be deployed with the expandable velocity string and then pulled back through the expandable velocity string to expand the string. In general, the expander tool can use a cone or rollers to increase the string's internal dimension.

Yet another technique for expanding the velocity string while deployed in the production tubing uses a trigger to initiate the expansion of the velocity string. For example, the trigger can involve applying an activating agent in the string's internal passage. The activating agent can then react with a material of the velocity string to cause it to expand. A number of activating agents can be used depending on the type of material used for the velocity string and the reaction used to produce the expansion.

The foregoing summary is not intended to summarize each potential embodiment or every aspect of the present disclosure.

DETAILED DESCRIPTION

As noted above, an effective technique for moving liquids through a horizontal gaseous well (e.g., a gas well or a gassy oil well) uses a velocity or dead string, but the string must be configured to produce the desired flow velocity to effectively lift liquids toward the surface. As expected, the string quickly becomes ineffective as the reservoir pressure decreases and gas flow declines. As noted previously, a conventional string installed in a horizontal borehole may be ineffective and may suffer from drawbacks. To overcome such issues, a velocity or dead string disclosed herein installs in a horizontal borehole and has an unexpanded state and one or more expanded states. Depending on the critical flow velocity required to lift liquid in the wellbore toward the surface, operators can initially install the string in its unexpanded state in the production tubing.

As the reservoir pressure decreases and backpressure increases due to liquid loading, operators can then expand the velocity string to achieve the critical flow velocity necessary to remove the liquids. Either the entire length of the velocity string can be expanded to reduce the overall micro-annulus in the production tubing or only select portions of the velocity string may be expanded. Considerations and calculations based on the parameters of the gas well determine the initial dimension of the velocity string to use, the expanded dimension of the velocity string, the reservoir pressure at which expansion should be done, and other factors evident to one skilled in the art having the benefit of the present disclosure.

The use of expandable tubing or other conduit for the velocity string thereby allows the flow velocity to be changed as the conditions of the gas well change. This can extend the useful life of the installed velocity string. Depending on the expandable velocity string's configuration, gas and/or surfactant can be injected from the surface to further enhance the effectiveness of the velocity string.

Figure 1:
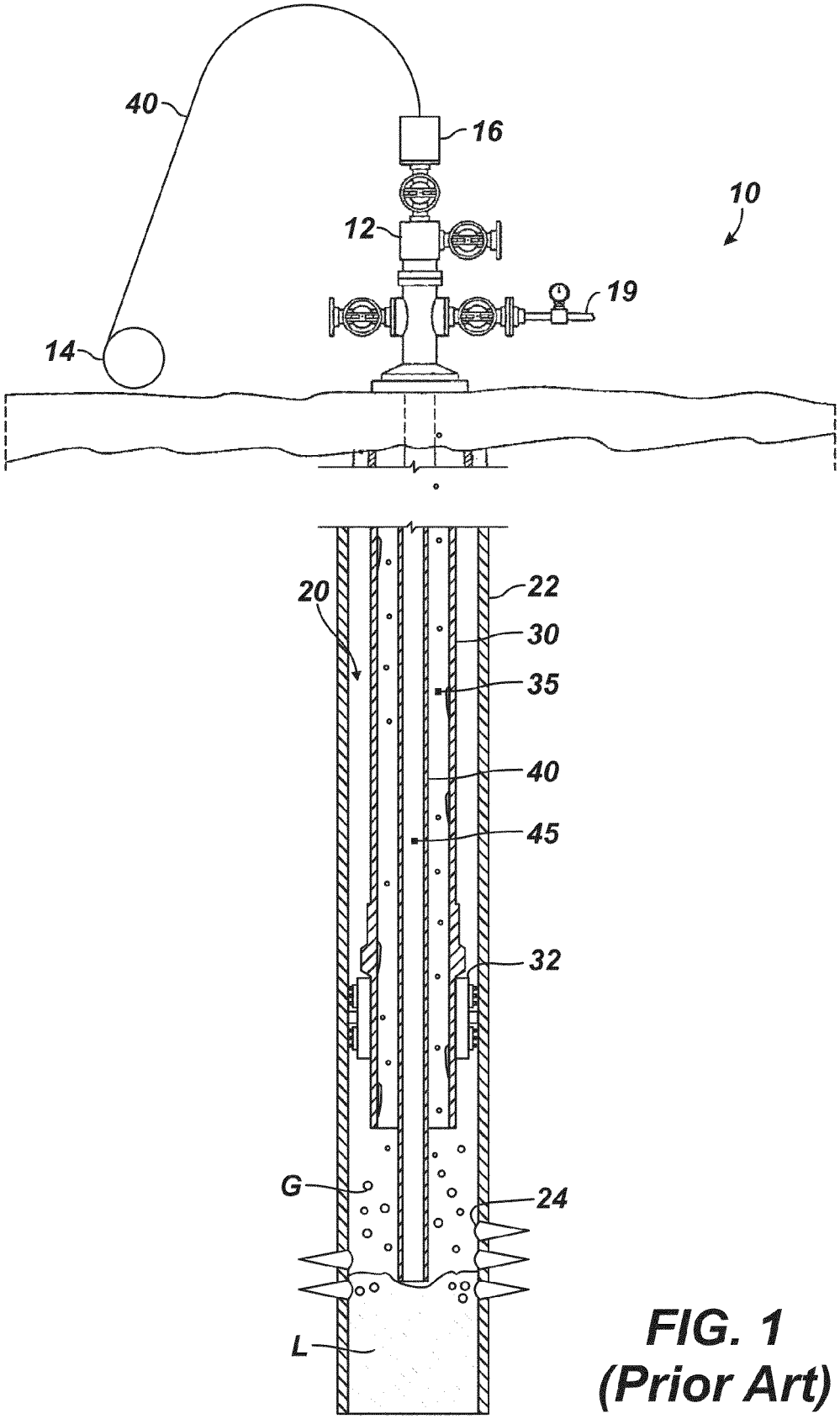
FIG. 1 (Prior Art)
FIG. 1 illustrates a velocity string according to the prior art installed in production tubing in a cased wellbore.
Figure 2:
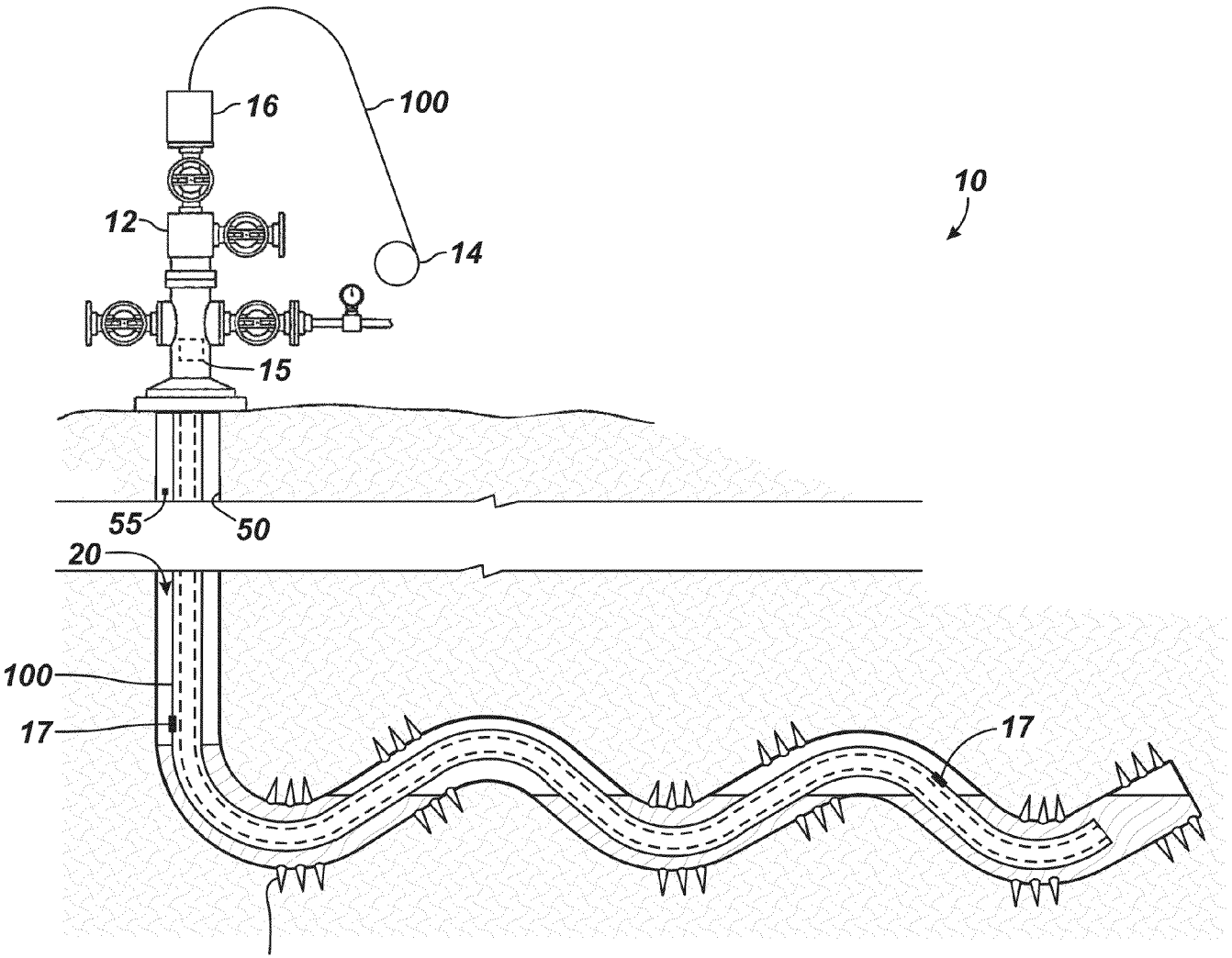
FIG. 2 illustrates a velocity string according to the present disclosure installed in production tubing in a cased wellbore.

To that end, the lift system 10 in FIG. 2 has an expandable velocity string 100 according to the present disclosure installed in production tubing 50 in the wellbore 20 of a gaseous well. In general, the gaseous well can be a natural gas well or a gassy oil well so that any reference herein to a "gaseous well," a "gas well," a "wellbore," or a "well" can apply equally to natural gas wells, gassy oil wells, or similar types of wells.

In general, the producing tubing 50 can be perforated casing, perforated tubing installed in casing, or any other typical configuration for a gas well so that some typical components are not shown. Here, the gas well is shown diagrammatically having a horizontal section of the wellbore 20 having the production tubing 50 with various perforations 52. Although the velocity string 100 is discussed herein for use in a horizontal well, the disclosed velocity string 100 can be used in vertical wells and wells having both vertical and horizontal intervals.

The velocity string 100 uses expandable tubing or conduit to reduce the flow area in the production tubing and maintain the flow velocity as well inflow declines. The velocity string 100 is typically tubing or conduit as shown and can have an internal passage 105, which can reduce the overall weight of the tubing and allow it to better deploy in the production tubing 50. However, depending on the material used and the purposes of the string 100, the disclosed velocity string 100 need not be hollow with an internal passage, may have a passage 105 but be used as a "dead" string, or may instead be a solid string without a passage.

Installed in its unexpanded state, the velocity string 100 can reduce the flow area and can increase the flow velocity to lift liquids toward the surface at least for an initial period of time. Accordingly, the overall cross-section (e.g., diameter) of the velocity string 100 in its unexpanded state can be selected to achieve the requisite critical flow velocity at least initially for the particular implementation, reservoir pressures, liquid accumulation, etc. As mentioned previously, the velocity string 100 can lift the liquid to the surface. Alternatively, the string 100 can lift the liquid at least partially toward the surface. For example, the string 100 can be used just to move the liquids through a horizontal section of the wellbore 20, whereby a different lift technology may be used to lift the liquids in the vertical section of the wellbore 20 to the surface.

Later, as the reservoir pressure decreases, the velocity string 100 can be expanded to further reduce the flow area so the flow velocities can be maintained above the "critical" velocity to move produced liquids. As discussed in more detail later, the expandable velocity string 100 can use elastomeric tubing, plastic tubing, metallic tubing, or a combination thereof. Depending on its composition, how long it is deployed, and other considerations, the velocity string 100 may or may not be retrievable. In the end, numerous parameters (current and future reservoir pressures, liquid and gas production rates, tubing diameter and depth, wellhead and flowing bottomhole pressures, etc.) govern the performance of the velocity string 100, as will be appreciated by those skilled in the art having the benefit of the present disclosure.

As an additional feature, one or more sensors 17 can be embedded in or disposed on the velocity string 100 to obtain downhole measurements of temperature, pressure, strain, orientation, vibration, etc. at specific locations along the string's length. For example, a distributed temperature sensor (DTS) system can be embedded in the velocity string 100 to obtain temperature measurements downhole along the string's length so the temperature measurements can be used for various purposes.

Although discussed in more detail later, the expandable velocity string can be composed of metallic, plastic, and/or elastomeric materials. For horizontal deployment when the velocity string 100 uses metal coil tubing, the velocity string 100 can be run as far as the longest 4½" and 5½" horizontal production tubing 50 can be run. The metal velocity string 100 could be retrieved as one string, but may break apart after an extended period of deployment. When metal coil tubing is used, the deployment may require some combination of a friction reducer, an agitator, and/or a tractor.

Figure 3A:
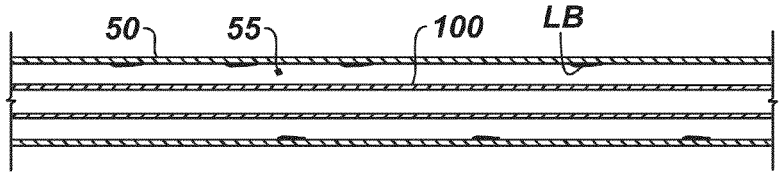
FIGS. 3A-3C show techniques for deploying the disclosed velocity string in a horizontal section of production tubing using chemical lubricants, an agitator, and a tractor.

To that end, a lubricant (LB) as shown in FIG. 3A can be applied down the production tubing 50 from the surface to reduce friction as the velocity string 100 is deployed downhole through the tubing 50. A number of lubricants (LB) known in the art can be used, including anionic polyacrylate emulsion, and the lubricant can have nano particles.

Figure 3B:
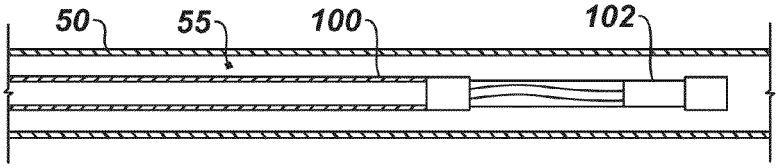

In other alternatives to facilitate horizontal deployment of the metal velocity string 100, a mechanical conveyance can be used to move the velocity string 100 through the horizontal section of the production tubing 50. As shown in FIG. 3B, for example, an agitator 102 or other form of mechanical vibrator disposed on the velocity string 100 can vibrate the string 100 as it is deployed down the production tubing 50 to reduce friction. Once the string 100 is in position, the agitator 102 can then remain downhole.

Figure 3C:
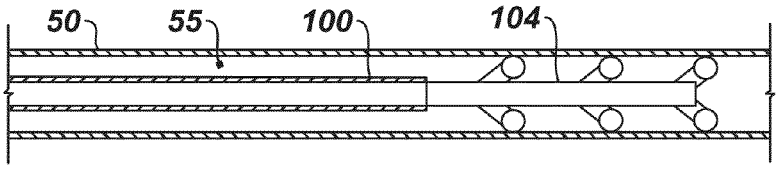

In another example shown in FIG. 3C, a tractor 104 can be used to pull the velocity string 100 through the production tubing 50. Once the string 100 is fully deployed, the tractor 104 can remain downhole. Although the use of a lubricant, agitator, or tractor may be particularly useful when the velocity string 100 uses metal tubing as opposed to some of the other forms of conduit disclosed herein, other forms of tubing could also benefit from the use of these techniques.

Depending upon geometry, the velocity string 100 may contract lengthwise as the string's cross-sectional area expands from an unexpanded state (U) to an expanded state (E). Therefore, the velocity string 100 in its unexpanded state (U) will be longer than when the sting 100 is in its expanded state (E). For example, it is expected that a cylindrical string 100 may contract 4% along its length for each 10% increase in the string's diameter. Therefore, if a mechanical conveyance such as an agitator or tractor is left downhole and attached to the string 100, it may be necessary for the velocity string 100 to be uncoupled from the conveyance before expanding the string 100 to avoid undue stress on the string 100 when it is expanded.

Figure 4A:
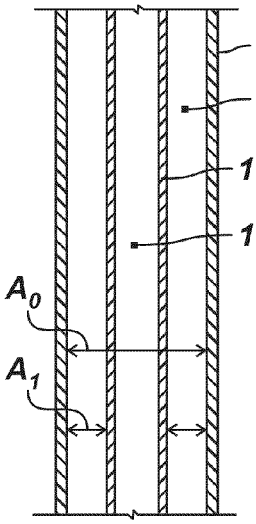
FIGS. 4A-4B show portion of the velocity string in an unexpanded state and an expanded state installed in production tubing.
Figure 4B:
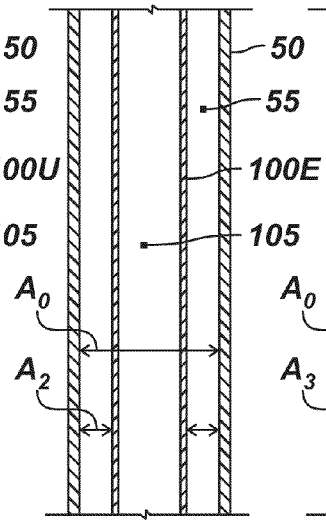

To further illustrate the velocity string 100, FIGS. 4A-4B show portion of the velocity string 100 in an unexpanded state (U) (FIG. 4A) and an expanded state (E) (FIG. 4B) installed in production tubing 50. As shown in FIG. 4A, the velocity string 100 in the unexpanded state (U) reduces the flow area of the production tubing 50 from its full area $A_0$ to a smaller area $A_1$ encompassing just the micro-annulus 55 (i.e., the annular space disposed outside the velocity string 100 and inside the production tubing 50). When the velocity string 100 is then in its expanded state (E) as in FIG. 4B, the velocity string 100 reduces the flow area of the production tubing 50 even further from to an even smaller area $A_2$ for only the micro-annulus 55 around the expanded string 100.

In some implementations, the velocity string 100 may be expanded as much as 20% to 40% beyond its initial, unexpanded state (U). A number of factors are considered to determine what the initial cross-sectional area of the velocity string 100 should be and what the expanded cross-sectional area should be. These factors depend on the details of a particular implementation and are calculated based on the length of the producing zone, the reservoir pressure, the backpressure, the liquid load, etc.

Figure 5A:
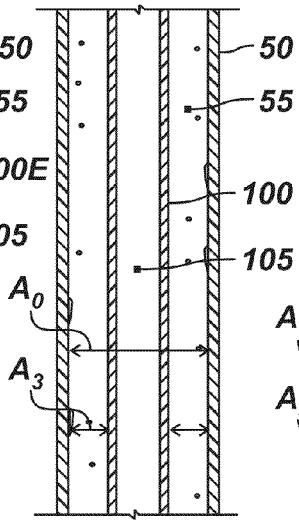
FIGS. 5A-5B show two flow schemes for the disclosed velocity string installed in production tubing.

As noted above, expansion of the velocity string 100 is intended to change the flow area so that critical flow velocity can be maintained. As will be appreciated, flow of production fluid in production tubing 50 having the expandable velocity string 100 can be implemented in number of ways. In FIG. 5A, for example, the production tubing 50 has the velocity string 100 disposed therein, and produced flow can pass through the micro-annulus 55 between the velocity string 100 and the production tubing 50. As can be seen, liquids (e.g., water and hydrocarbons) can be lifted in the micro-annulus 55 with the produced gas flow when critical velocity is achieved. Flow is not present in the internal passage 105 of the velocity string 100 in this case. Expansion of the velocity string 100 would decrease the flow area $A_3$ in the micro-annulus 55 as described previously to increase the flow velocity to lift the produced liquids.

Figure 5B:
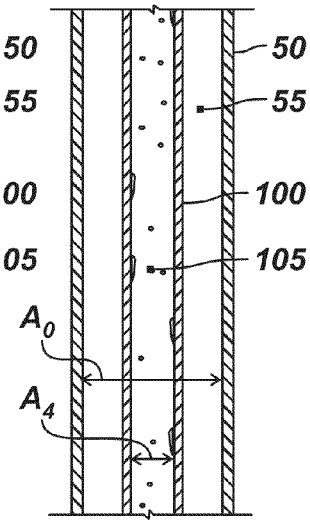

As an alternative, FIG. 5B show a different flow scheme for the disclosed velocity string 100 installed in the production tubing 50. Here, flow of produced gas and fluid is through the velocity string's passage 105 and not the micro-annulus 55. This scheme may be used, but expansion of the velocity string 100 would instead increase the flow area $A_4$ through the velocity string 100. Therefore, if an increase in flow velocity is needed, the lift system 10 can be altered after expansion of the velocity string 100 so that the produced fluid flows in the decreased micro-annulus 55 between the string 100 and the tubing 50 as in FIG. 5A.

As a further alternative, flow of produced fluid may initially be through both the velocity string's passage 105 and the micro-annulus 55. In such a scheme, the amount of cross-sectional area taken up by the velocity string 100 itself would reduce the overall flow area $A_0$ to influence the flow velocity. Then, when increased flow velocity is needed, the produced fluid can be switched to flow through only velocity string's passage 105. Still further, when further increased flow velocity is needed, the produced fluid can be switched to flow through the micro-annulus 55 as long as its flow area $A_3$ is smaller than the flow area $A_4$ of velocity string's passage 105. Finally, the flow area $A_3$ of the micro-annulus 55 can then be reduced by expanding the velocity string 100 to increase flow velocity even more.

As will be appreciated, a manifold disposed at some point along the production tubing 50 and the velocity string 100 can be used to alter the flow through the tubing 50 and/or velocity string 100. For example, FIG. 2 schematically shows a manifold 15 disposed in the wellhead 12 along the tubing 50 and the velocity string 100. In general, the manifold 15 can include the various valves and flow paths associated with the wellhead 12, which can be adjusted at the surface. Changing the fluid communication through the manifold 15 can alter how produced fluid flows uphole toward the surface—i.e., through the micro-annulus 55, the velocity string's passage 105, or both.

Depending on the differences in flow area inside the sting's passage 105 and the micro-annulus 55, the system 10 can switch flow between them to adjust the resulting flow velocity. The same is true after the velocity string 100 has been expanded. Moreover, current discussion has focused on the expandable velocity string 100 being installed in an unexpanded state (U) in the production tubing 50 and later expanded to the expanded state (E) to decrease the flow area of the micro-annulus 55 and increase the flow velocity. The reverse can also be used, in which the velocity string 100 is installed expanded and is later constricted or reduced in cross-sectional area to increase flow velocity though the velocity string's internal passage 105. Overall, however, using the velocity string 100 that can expand to increase flow velocity in the micro-annulus 55 may be preferred for horizontal wells so that produced fluid from the various perforations on the well can be lifted up the annulus and need not travel first to the end of the string to pass up the string's internal passage 105.

Before going into particular types of tubing that can be used for the expandable velocity string 100, discussion first turns to a number of techniques for expanding the velocity string 100 from an unexpanded state (U) to an expanded state (E). In general and as further detailed below, the techniques for expanding the velocity string 100 can use pressure inside of the string 100 capped at its end; mechanical techniques including pigs, rams, pills, bullets, rollers, etc., which can be driven hydraulically, electrically, or mechanically from (or toward) the surface; and triggered reactions (i.e., including chemical reactions, hydrophilic reactions, heat reactions, and the like) with polymers or other materials of the string 100.

Figures 6A, 6B, 6C, 6D:
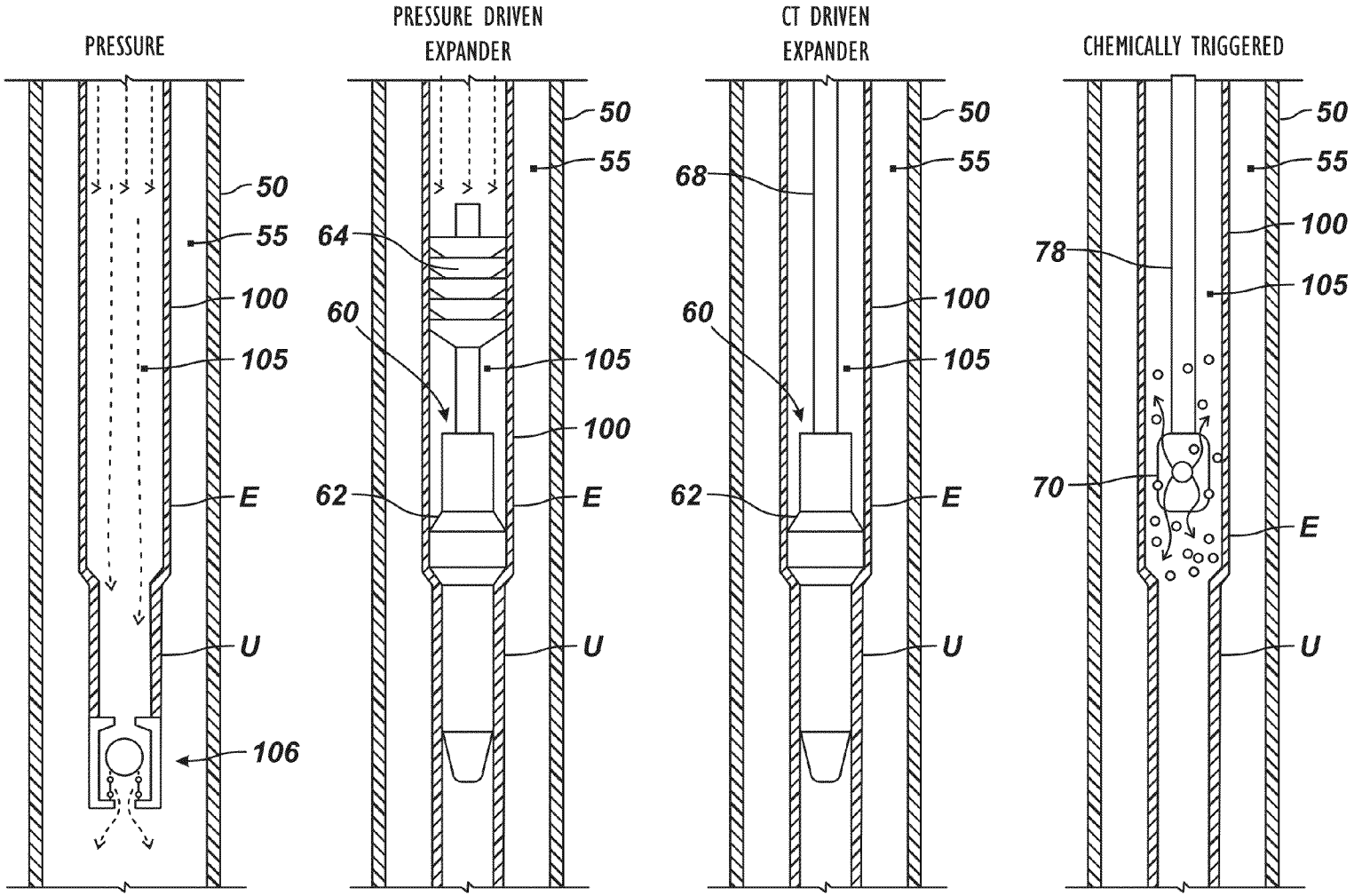
FIGS. 6A-6D show techniques for expanding the disclosed velocity string using pressure, a pressure driven expander, a coil tubing driven expander, and an activating trigger.

In FIG. 6A, for example, pressure is applied from the surface into the internal passage 105 of the velocity string 100 to expand it outward to its expanded state (E). A check valve 106 is disposed on the velocity string 100, such as at the end of the tubing. The check valve 106 allows excess pressure above some threshold to escape but to prevent an influx of pressure. Pressurized expansion preferably uses an inert gas. Liquid may also be used even though it may result in the need to pull a wet velocity string later from the well or may introduce liquid into the producing interval.

In FIGS. 6B and 6C, an expander tool 60 expands the velocity string 100 outward to decrease the micro-annulus 55 in the production tubing 50. In FIG. 6B, pressure (preferably from gas) applied from the surface forces the expander tool 60 along the internal passage 105 of the velocity string 100. Accordingly, cup packers or other sealing elements 64 can be used to seal the tool 60 in the velocity string 100 so the applied pressure forces the tool 60 through the passage 105.

A lubricant can be used in the velocity string 100 to reduce friction if necessary. The expander tool 60 can then be left in the string 100. A reverse arrangement can also be used, in which the expander tool 60 is deployed with the expandable velocity string 100 so injected gas in the producing tubing 50 can enter the distal end (not shown) of the velocity string 100 and move the tool 60 uphole to the surface.

In FIG. 6C, the expander tool 60 is instead driven by coil tubing 68 deployed from the surface through the internal passage 105 of the velocity string 100 and coupled to the end 66 of the tool 60. If feasible, a lubricant can be supplied down the coiled tubing 68 and out orifices on the expander tool 60 to reduce friction. The expander tool can be left in the string 100 or removed with the coil tubing 68 as applicable. A reverse arrangement can also be used, in which the expander tool 60 is deployed with the expandable velocity string 100 so the coil tubing 68 can pull the tool 60 uphole through the string 100 to the surface.

Figure 10A:
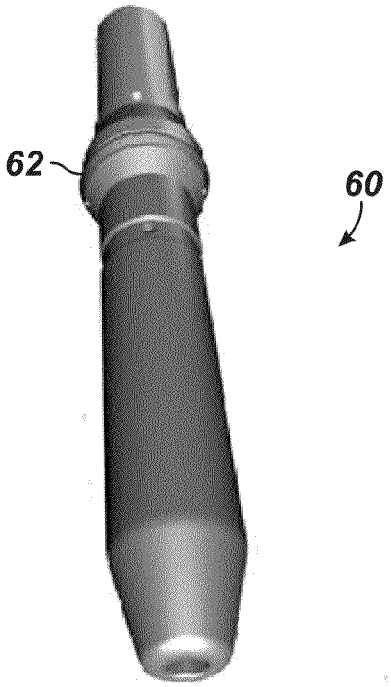
FIGS. 10A-10B show two types of expansion tools for expanding the disclosed velocity string.
Figure 10B:
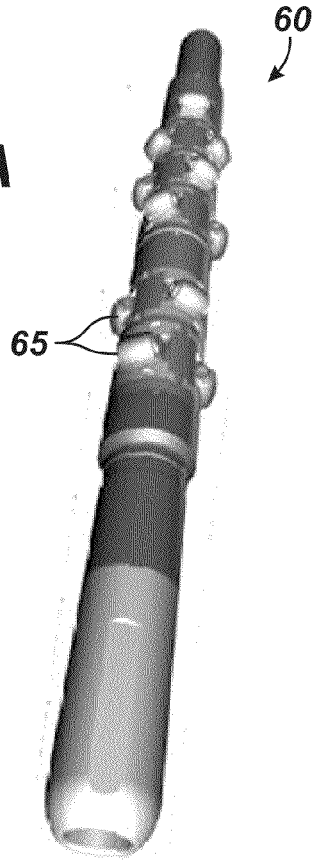

In these FIGS. 6B-6C, the expander tool 60 uses a cone 62 of an increased diameter to expand the velocity string 100. Further details of this type of expander tool 60 are shown in FIG. 10A. Depending on the type of tubing used for the velocity string 100, various procedures and other types of tools may be used to expand the string, including pigs, rams, pills, bullets, rollers, and the like. For example, the expander tool 60 can use a roller system 65 as in FIG. 10B.

Finally, FIG. 6D shows a trigger being used to expand the velocity string 100. The trigger can be delivered down the internal passage 105 of the velocity string 100 with or without a tool. As depicted, coil tubing 78 can be used to convey an applicator 70 and deliver the trigger along the length of the velocity string 100. The trigger can use an activating agent, such as water, steam, or chemical, for example, so that the applicator 70 can be a flow nozzle connected to the coil tubing 78. In the instance where water is the agent, the velocity string 50 can be at least partially composed of a water-swellable elastomer that expands in the presence of water. Rather than being applied with an applicator 70 and coil tubing 78, the internal passage 105 of the string 100 can simply be filled with the agent. Other activating agents could be used to trigger expansion. For example, steam, heat, chemical substance, electric charge, or the like can be applied to the velocity string 100, preferably through its internal passage 105, to cause the string 100 to expand. Accordingly, at least a portion of the velocity string 100 is composed of a material suited to change shape and expand the string 100 in response to the particular agent.

With an understanding of the velocity string 100 and its use, discussion now turns to various types of expandable tubing that can be used for the disclosed velocity strings 100. The expandable tubing for the string 100 can be made from any of the materials currently available for the different types of coiled tubing used in wells. Moreover, as noted previously, the expandable velocity string 100 can use elastomeric tubing, plastic tubing, metallic tubing, or a combination thereof.

The velocity string 100 preferably maintains its expanded shape without relaxing. Therefore, the expansion may produce permanent deformation of the tubing's material. Overall, the velocity string 100 is preferably designed to have a biased stiffness to limit its expansion.

For metallic tubing, the velocity string 100 can be composed of a carbon steel, stainless steel alloy, shape memory alloy, or the like. For plastic tubing, the velocity string 100 can be at least partially composed of a thermoplastic, polymer, or an elastomer. For example, the tubing can be composed at least partially of a flouroelastomer, such as Teflon, polytetrafluoroethylene (PTFEP), fluorinated ethylene propylene (FEP), perfluoroalkoxy (PFA), etc. These flouroelastomers can provide suitable temperature resistance, strength, and lubricity for the downhole implementation. The tubing can be composed of various types of polymers or thermoplastics, including shape memory polymers, thermoplastic polyurethanes (TPU), thermoplastic elastomer (TPE), acrylonitrile butadiene styrene (ABS), polyoxymethylene (POM), polyamide (PA), polyetherketone (PEK), polyetherketoneketone (PEKK), polyether ether ketone (PEEK), polytetrafluoroethylene (PTFE), PerFluoroAlkoxy (PFA), TetraFluorEthylene-Perfluorpropylene (FEP), ethylene tetrafluoroethylene (ETFE), polyvinylidene fluoride (PVDF), ployethersulfone (PES), poly(methyl acrylate) (PMA), poly(methyl methacrylate) (PMMA), and polyphenylsulfone (PPSU). Other materials that can be used include glass fiber-reinforced epoxy laminates, composites, fluoropolymers, polyvinyl chloride (PVC), and various types of rubber, including hydrogenated Acrylonitrile-Butadiene Rubber (HNBR), fluoroelastomer (FKM), and nitrile rubber (NBR).

Figure 7A:
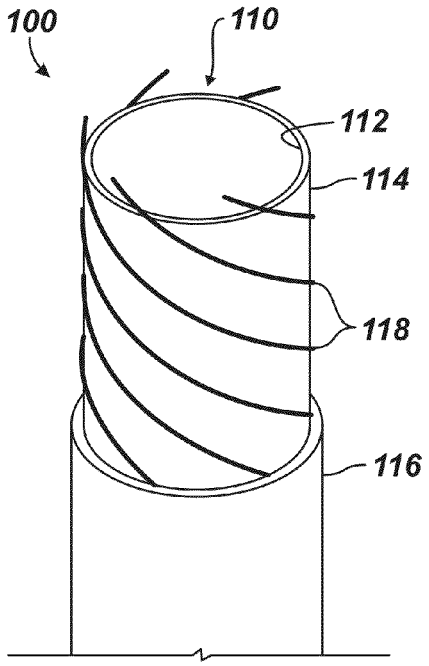
FIG. 7A shows one geometry for a conduit used for the disclosed velocity string.

In addition to the various materials that can be used, the velocity string 100 can have tubing with different geometries that allow for expansion. As shown in FIG. 7A, for example, one geometry for the tubing 110 used for the disclosed velocity string 100 can have a round or circular cross-section so that the tubing 110 is essentially cylindrical or tubular in nature. Depending on the materials used, the tubing 110 can comprise a single layer or can have multiple layers 114/116 as shown. Here, for example, the tubing 110 for the velocity string 100 has an inner layer 114 with an internal passage 112 and has an outer layer 116 disposed about the inner layer 114. These two layers 114 and 116 can be composed of the same or different materials depending on what fluids they will be exposed to and what expansion properties they provide.

As also shown, a reinforcement layer 118 can be used between the inner and outer layers 114 and 116 to provide tensile and expansion strength to the tubing 110. The reinforcement layer 118 may be particular useful for non-metallic tubing used. The reinforcement layer 118 can include structural fibers arranged to limit the tubing's expansion to specific target diameters and to limit the tubing's extension. For example, longitudinally arranged fibers of the reinforcement layer 118 can provide stiffness, while helically arranged or wound fibers of the layer 118 can control the tubing's expanded size. Other than structural fibers, the layer 118 can use mesh, fabric, and the like. In addition to or as an alternative to the reinforcement layer 118, the materials used for the tubing's layers 114/116 can have non-linear stress-strain relationships, which can be used to limit expansion to specific target diameters.

Figure 7B:
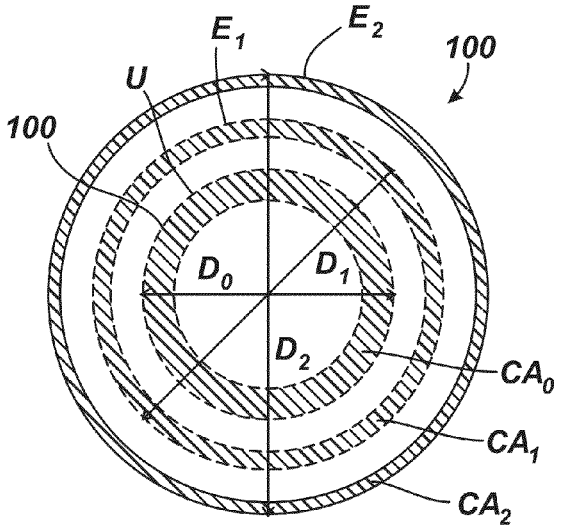
FIG. 7B shows end-sections of a cylindrical conduit as in FIG. 7A during stages of expansion.

Expansion of the cylindrical tubing 110 for the velocity string 100 can preferably be done in at least two stages to avoid damage and over-extrusion of the tubing's materials. For example, FIG. 7B shows cross-sections of cylindrical tubing 110 for the velocity string 100 during two stages of expansion. Overall, the tubing's cross-section may be increase by about 40%. In its initial, unexpanded state (U), the tubing 110 has an initial diameter of $D_0$ with an initial cross-sectional area $CA_0$. After a first stage of expansion (e.g., with a suitably sized expansion tool), the tubing's diameter is increased to an intermediate diameter of $D_1$ with an intermediate cross-sectional area $CA_1$. Then, the tubing's diameter is increased to a final diameter of $D_2$ and cross-sectional area $CA_2$ after a second stage of expansion. Although the final diameter $D_2$ may be the diameter desired to increase the flow velocity, it is possible that even the intermediate diameter (e.g., $D_1$) at an earlier stage may provide the desired flow velocity in the system for at least a period of time. Therefore, the multiple stages of expansion do not necessarily need to be performed right after one another as long as the well is able to produced liquids with the velocity string 100 expanded intermediately.

Figure 8A:
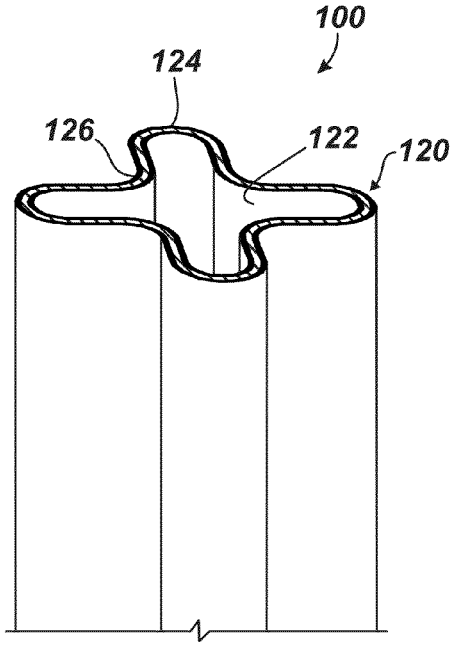
FIG. 8A shows another geometry for a conduit used for the disclosed velocity string.

Other contours besides cylindrical can be used for the velocity string 100, and the initial shape of the string 110 can be non-round. For example, FIG. 8A shows another geometry for tubing 120 used for the disclosed velocity string 100. Here, initially cylindrical tubing 120 has been crimped longitudinally along its length to produce a number of outward longitudinal ribs 124 and inward crimps 126 about an irregularly shaped internal passage 122. Over all, this crimping produces a decreased cross-sectional area of the string 100. To form the tubing 120 into such a non-round cross-section, cylindrical tubing can be pulled through a die or rollers to form longitudinal corrugations or ribs 124 and crimps 126. It should be noted that snubbing such non-round tubing 120 downhole may not be possible against pressure so deployment of the string 100 in the production tubing of the system would need to account for this limitation. Accordingly, a tractor as discussed previously could be used instead.

Figure 8B:
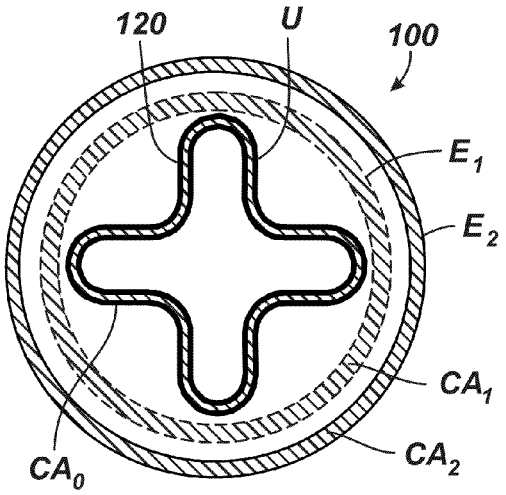
FIG. 8B shows end-sections of the conduit of FIG. 8A during stages of expansion.

Expansion of this irregular tubing 120 of FIG. 8A can also be performed in a number of stages, as shown in FIG. 8B. A first stage of expansion may revert the tubing 120 from its crimped, unexpanded state (U) to its cylindrical shape with an intermediate diameter $D_1$, thus increasing its cross-sectional area from an initial area $CA_0$ to an intermediate area $CA_1$. For example, application of pressure in the tubing's passage 122 can expand the formed tubing 120 back to its original round shape. In this case, a lower pressure may be required to make this initial expansion than would be required to expand cylindrical tubing.

Then, in a subsequent stage, the tubing 120 can be expanded to an expanded state (E) with a larger diameter $D_2$ with larger area $CA_2$. This expansion can be performed with an expansion tool, for example, as opposed to applied pressure alone. In some cases, the tubing's diameter can be increased by about 40% from the outside diameter of its collapsed shape to the outside diameter of its cylindrical shape. Although the change in cross-sectional area depends on the tubing's initial state, the cross-sectional area can increase as much as about 50% from its initial cross-sectional area $CA_0$ to its new cross-sectional area $CA_1$ or $CA_2$.

Figure 9:
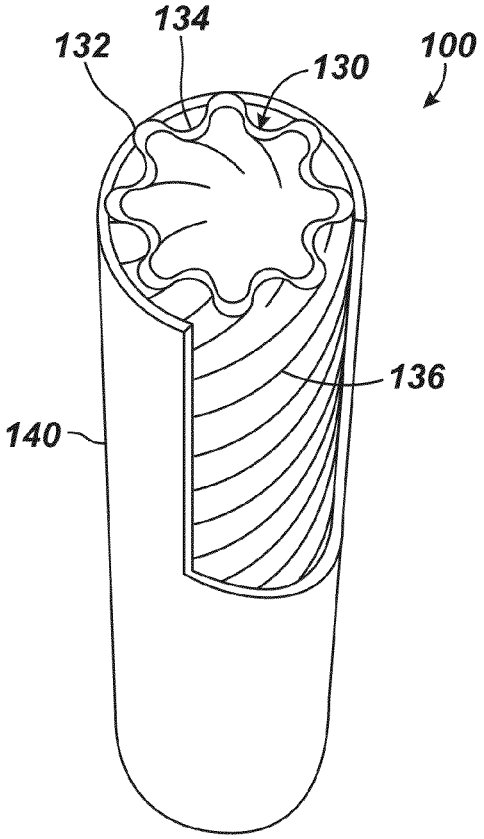
FIG. 9 shows another geometry for a conduit used for the disclosed velocity string.

Still other geometries for the velocity string 100 can be used. In FIG. 9, tubing 130 for the velocity string 100 has an external sheath 140 that can provide a uniform external surface, which will be exposed in the micro-annulus when deployed downhole. Inside the sheath 140, the tubing 130 has a plurality of ribs or corrugations 132 formed in spirals 136 along the length of the tubing 140. This tubing 130 can also be expanded in stages first using pressure and then using an expansion tool, for example.

Although mentioned previously, FIGS. 10A-10B show two types of expansion tools 60 for expanding the disclosed velocity string. The expansion tool 60 in FIG. 10A uses a cone 62 to expand the velocity string, while the expansion tool 60 in FIG. 10B uses a roller system 65 to expand the velocity string. Either way, these tools 60 can be pushed or pulled through the string 100 using pressure, coiled tubing, and any of the other techniques discussed above. Furthermore, although shown for expansion, inverse arrangements of these tools could be used for constricting or reducing the dimension of the string 100 by fitting in the micro-annulus between the string 100 and production tubing 50 and reducing the outer diameter of the string 100 while moving along the string's length, for example.

As hinted to previously, expansion of the velocity string 100 can be performed in stages, and each stage can use the same or different expansion technique. Additionally, expansion of the velocity string 100 can be performed consistently along the length of the string's tubing. Tapering of the velocity string 100 may also be helpful in wells where long producing intervals result in a varying flow velocity throughout the producing interval. Although useful in some implementations, consistent expansion or tapering may not always be necessary. Instead, selected sections of the velocity string 100 may be expanded along its length to increased dimensions while other selected sections are not expanded (or are expanded to less increased dimensions). This selective expansion may be beneficial when the production tubing 50 has different restrictions, internal dimensions, or the like along its length or when different flow areas may facilitate production, decrease erosion, or provide some benefit at different points along the well.

To achieve the selective expansion (or tapering), the expansion tool 60 can be actuated hydraulically, electrically, or mechanically between actuated and unactuated states to perform the selective expansion of the velocity string 100. For example, the roller system 65 on the expansion tool 60 of FIG. 10B can be selectively actuated when deployed in the velocity string 100. These and other techniques can be used as will be appreciated with the benefit of the present disclosure.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of lifting fluid produced from a gaseous well toward the surface, the method comprising:

reducing a flow area of the gaseous well by deploying a velocity string in production tubing of the gaseous well;

lifting the produced fluid through the reduced flow area at least partially toward the surface;

decreasing the reduced flow area of the gaseous well by adjusting a cross-sectional dimension of the velocity string while deployed in the production tubing; and lifting the produced fluid in the decreased flow area at least partially toward the surface.

2. The method of claim 1, wherein lifting the produced fluid comprises lifting produced gas and liquid at least at a critical flow velocity.

3. The method of claim 1, wherein reducing the flow area of the gaseous well comprises decreasing an initial flow area through the production tubing by a first cross-sectional area defined by the velocity string in a first state.

4. The method of claim 3, wherein decreasing the reduced flow area of the gaseous well comprises decreasing the reduced flow area by a second cross-sectional area defined the velocity string in a second state, the second cross-sectional area being greater than the first cross-sectional area.

5. The method of claim 1, wherein lifting the produced fluid in the reduced flow area at least partially toward the surface comprises lifting the produced fluid through an internal passage of the velocity string.

6. The method of claim 5, further comprising switching communication of the produced fluid from the internal passage of the velocity string to an annulus defined between the velocity string and the production tubing.

7. The method of claim 1, wherein lifting the produced fluid in the reduced flow area at least partially toward the surface comprises lifting the produced fluid through an annulus defined between the velocity string and the production tubing.

8. The method of claim 7, further comprising switching communication of the produced fluid from the annulus to an internal passage of the velocity string.

9. The method of claim 1, wherein adjusting the cross-sectional dimension of the velocity string while deployed in the production tubing comprises constricting an internal passage of the velocity string or increasing an amount of cross-sectional area taken up by the velocity string within the production tubing.

10. The method of claim 1, wherein adjusting the cross-sectional dimension of the velocity string while deployed in the production tubing comprises expanding the velocity string while deployed in the production tubing.

11. The method of claim 10, wherein expanding the velocity string while deployed in the production tubing comprises increasing a cross-sectional area of the velocity string in one or more expansion stages.

12. The method of claim 10, wherein expanding the velocity string while deployed in the production tubing comprises injecting fluid pressure in an internal passage of the velocity string.

13. The method of claim 12, wherein injecting the fluid pressure comprises releasing at least a portion of the fluid pressure from a check valve on the velocity string.

14. The method of claim 10, wherein expanding the velocity string while deployed in the production tubing comprises forcing an expander tool through an internal passage of the velocity string.

15. The method of claim 14, wherein forcing the expander tool comprises applying fluid pressure in the internal passage behind the expander tool.

16. The method of claim 14, wherein forcing the expander tool comprises moving the expander tool at least partially in the internal passage with coil tubing.

17. The method of claim 10, wherein expanding the velocity string while deployed in the production tubing comprises initiating the expansion of the velocity string with a trigger.

18. The method of claim 17, wherein initiating the expansion of the velocity string with the trigger comprises applying an activating agent at least partially in an internal passage of the velocity string and reacting the activating agent with a material of the velocity string.

19. The method of claim 18, wherein the activating agent is selected from the group consisting of water, steam, heat, chemical substance, electricity, and a combination thereof.

20. The method of claim 1, wherein deploying the velocity string in the production tubing of the gaseous well comprises lubricating the production tubing, vibrating the velocity string in the production tubing with an agitator, or pulling the velocity string with a tractor in the production tubing.

21. The method of claim 1, wherein deploying the velocity string in the production tubing of the gaseous well comprises:

initially deforming the velocity string from an expanded state to an unexpanded state; and deploying the velocity string in the unexpanded state.

22. A fluid lift system for a gaseous well, the system comprising:

a velocity string deploying in production tubing of the gaseous well and having a first state with a first cross-sectional dimension, the first cross-sectional dimension reducing a flow area of the production tubing and configured to produce an initial flow velocity in the gaseous well, the velocity string being adjustable to at least one second state with at least one second cross-sectional dimension when deployed in the production tubing, the at least one second cross-sectional dimension decreasing the reduced flow area and configured to produce at least one subsequent flow velocity in the gaseous well.

23. The system of claim 22, further comprising at least one expander tool movable in an internal passage of the velocity string and expanding the velocity string from the first state to the at least one second state.

24. The system of claim 23, wherein the at least one expander tool comprises a pressure seal disposed thereon, the pressure seal sealing fluid pressure in the internal passage of velocity tube.

25. The system of claim 23, wherein the at least one expander tool comprises a coupling for coil tubing disposed thereon.

26. The system of claim 22, further comprising a mechanical conveyance disposed on the velocity string and facilitating deployment of the velocity string in the production tubing.

27. The system of claim 22, further comprising a check valve disposed on the velocity string and controlling fluid commination from an internal passage of the velocity string.

28. The system of claim 22, wherein the velocity string comprises tubing composed of a material selected from the group consisting of metal, plastic, elastomeric, and a combination thereof.

29. The system of claim 22, wherein the velocity string comprises tubing having an initial cross-sectional area deformed longitudinally into a subsequent cross-sectional area, the subsequent cross-sectional area being less than the initial cross-sectional area.

30. The system of claim 22, wherein the velocity string comprises tubing having a plurality of layers.

31. The system of claim 30, wherein one of the layers of the velocity string comprises a reinforcement layer restricting expansion of the velocity string.

32. A fluid lift system for a gaseous well, the system comprising:

a velocity string deploying in production tubing of the gaseous well and reducing a flow area in which produced fluid is lifted at least partially toward the surface; and means for adjusting a cross-sectional dimension of the velocity string while deployed in the production tubing to decrease the reduced flow area in which the produced fluid is lifted at least partially toward the surface.

33. The system of claim 32, wherein the means for adjusting comprise means for expanding the cross-sectional area of the velocity string disposed in the production tubing.

34. The system of claim 33, wherein the means for expanding the cross-sectional area comprises means for injecting fluid pressure in the cross-sectional area of the velocity string disposed in the production tubing.

35. The system of claim 33, wherein the means for expanding the cross-sectional area comprise means for forcing an increased cross-section in the cross-sectional area through the velocity string.

36. The system of claim 35, wherein the means for forcing the increased cross-section in the cross-sectional area comprises means for mechanically moving the increased cross-section through the velocity string.

37. The system of claim 35, wherein the means for forcing the increased cross-section in the cross-sectional area comprises means for hydraulically moving the increased cross-section through the velocity string.

38. The system of claim 33, wherein the means for expanding the cross-sectional area comprise means for triggering the expansion of the cross-sectional area of the velocity string.

39. The system of claim 32, further comprising means for switching communication of the produced fluid between an internal passage of the velocity string and an annulus defined between the velocity string and the production tubing.

* * * * *